US007631470B2

(12) United States Patent
Kinoshita

(10) Patent No.: US 7,631,470 B2
(45) Date of Patent: Dec. 15, 2009

(54) HELIPORT AND CIVIL ENGINEERING/BUILDING MATERIAL

(75) Inventor: Motomi Kinoshita, Chiba (JP)

(73) Assignee: Aero Facility Co., Ltd., Tokyo (JP)

( * ) Notice: Subject to any disclaimer, the term of this patent is extended or adjusted under 35 U.S.C. 154(b) by 870 days.

(21) Appl. No.: 10/502,772

(22) PCT Filed: Dec. 11, 2002

(86) PCT No.: PCT/JP02/12979

§ 371 (c)(1),
(2), (4) Date: Jul. 28, 2004

(87) PCT Pub. No.: WO2004/053233

PCT Pub. Date: Jun. 24, 2004

(65) Prior Publication Data

US 2005/0126101 A1 Jun. 16, 2005

(51) Int. Cl.
*E04B 1/00* (2006.01)
*E04B 5/00* (2006.01)

(52) U.S. Cl. ..... 52/591.5; 52/581; 52/588.1; 52/582.1; 52/583.1; 52/590.2; 52/590.3; 52/591.2; 52/591.3; 52/592.4; 52/592.1

(58) Field of Classification Search ..... 52/483.1, 52/492.1, 177, 588.1, 578, 589.1, 591.1, 52/592.1, 650.3, 730.5, 731.3, 732.2, 580–581, 52/582.1, 586.1, 586.2, 263
See application file for complete search history.

(56) References Cited

U.S. PATENT DOCUMENTS

| | | | | | |
|---|---|---|---|---|---|
| 69,297 | A * | 9/1867 | Stafford | 404/39 |
| 1,778,352 | A * | 10/1930 | Bruce | 52/390 |
| 2,681,190 | A | 6/1954 | Thomson | |
| 2,920,846 | A | 1/1960 | Lingafelter | |
| 3,319,543 | A * | 5/1967 | Braeuninger et al. | 404/35 |
| 3,348,459 | A * | 10/1967 | Harvey | 404/35 |
| 3,686,817 | A * | 8/1972 | Adams | 52/586.2 |
| 3,840,308 | A * | 10/1974 | Glaze | 404/35 |
| 5,205,087 | A * | 4/1993 | Jines | 52/6 |
| 5,474,029 | A * | 12/1995 | Hofer | 119/73 |
| 6,446,413 | B1 * | 9/2002 | Gruber | 52/747.11 |
| 6,617,009 | B1 * | 9/2003 | Chen et al. | 428/195.1 |
| 6,675,545 | B2 * | 1/2004 | Chen et al. | 52/586.1 |
| 6,918,221 | B2 * | 7/2005 | Williams | 52/592.1 |

FOREIGN PATENT DOCUMENTS

| | | |
|---|---|---|
| JP | 52-11913 U | 1/1977 |
| JP | 2-37916 U | 12/1978 |
| JP | 53-165618 U | 12/1978 |
| JP | 63-101298 U | 7/1988 |

* cited by examiner

*Primary Examiner*—Jeanette Chapman
(74) *Attorney, Agent, or Firm*—Sughrue Mion, PLLC

(57) ABSTRACT

In a heliport of the present invention, a plurality of long deck materials are arranged and joined to form a planar member having an approximately plane structure. The planar member is placed on a structure such as a space framework that can float on water, or on another floating structure. The planar member can serve as a top surface of a heliport surface or as a foundation for the heliport.

14 Claims, 15 Drawing Sheets

HELIPORT AND CIVIL ENGINEERING/BUILDING MATERIAL

TECHNICAL FIELD

The present invention relates to a heliport, and a building and construction member that can be placed on a simple floating structure and has strength tolerable for a peculiar impact load and concentrated load.

BACKGROUND ART

In recent years, prefabrication-type heliports made of aluminum have widely been used in place of those made of asphalt or concrete. The aluminum heliport is prefabricated, and therefore, it can be placed on a roof of a building, ground or the like more easily than an asphalt heliport or the like. Moreover, the aluminum heliport has advantages such that the structural strength of the building can be reduced and so on, due to the lightweight heliport. FIG. 20 and FIG. 21 are a whole structural drawing and a perspective assembly view, respectively, of a conventional heliport. A conventional heliport 100 employs a prefabrication style and is constructed using deck materials 110, beams 120 and cross beams 130. A plurality of the deck materials 110 are crossed over and bedded on the beams 120 to form a heliport surface H. The deck materials 110, 110 adjacent to each other are not joined directly to each other; each deck material is connected onto the beams 120 and fixed to the beam with bolts. A plurality of the beams 120 are crossed over the cross beams 130 to serve as the foundation of the deck materials 110. The cross beams 130 are constructed by crossing large-sized beams over columns that are provided on a flat ground or on a roof of a building, and serve as the foundation of the beams 120. No patent applications on the above conventional heliport 100, with respect to the problems to be solved described later, have been made in Japan. Therefore, the description of related patent literature is omitted.

Recently, demands have been made for a prefabricated heliport 100 that can be easily placed on water. For such a heliport, a structure is proposed, in which the deck materials 110 are bedded on a structure floating on water and that serves as the foundation (the drawing omitted). A few floating structures having sufficient strength and that can easily be set on water in case of emergency, are available. However, many of such floating structures are not rigid enough or are too brittle to serve as the foundation for a heliport. If the beams 120 are provided on such a floating structure and the deck materials 110 are bedded thereon, there is a problem in that a concentrated load and an impact load peculiar to heliport damages the floating structure.

The present invention has been carried out considering the above problems, and the objects of the present invention are to provide a heliport as well as a building and construction member that can be placed on a simple floating structure and have strength tolerable for a peculiar impact load and concentrated load.

DISCLOSURE OF THE INVENTION

To achieve the above objects, a heliport according to an aspect of the present invention includes a planar member that is formed by arranging and joining together a plurality of long deck materials, and a floating structure that supports the planar member and that floats on water. The planar member functions as a top surface of a heliport surface or as a foundation for the heliport.

In the above invention, the planar member is constructed by arranging and joining a plurality of long deck materials. Such planar member has a constant flexural rigidity in the planar direction. Due to such structure, the perpendicular load acting on the planar member is distributed and the floating structure is loaded, compared to the structure in which the deck materials are independently arranged on the floating structure. Thus, there is an advantage that a heliport can be placed on a simple floating structure such as a truss or a raft. The floating structures include, for example, structures that can be easily assembled by workers such as rafts, floatable truss-structures, frame structures or crib structures and other simple structures. When such a simple structure is used for the foundation of the planar member, there is an advantage that a heliport can easily be constructed at any desired place.

A heliport according to another aspect of the present invention includes a planar member that is formed by arranging and joining together a plurality of long deck materials to form a surface having an approximately plane structure. The planar member functions as a top surface of a heliport surface or as a foundation for the heliport. The heliport also includes a supporting structure that supports the planar member, where a bottom surface of the planar member is joined to the supporting structure with joining pieces.

In the above invention, the planar member is supported by a supporting structure and functions as a heliport surface or the foundations of the heliport. Here, the back surface of the planar member is connected to the supporting structure with joining pieces. This leads to an advantage that the planar member is fixed onto the supporting structure such as a space framework.

A heliport according to still another aspect of the present invention includes a planar member that is formed by arranging and joining together a plurality of long deck materials to form a surface having an approximately plane structure and a frame structure on which the planar member is placed and that supports a bottom surface of the planar member. The planar member functions as a top surface of a heliport surface or as a foundation for the heliport.

For example, in a structure that requires large space such as gymnasium or warehouse, a distance between columns is so large that the roof is constructed in a plane-type truss in view of strength. In recent years, demands have been made for a heliport that can be placed on such a plane-type truss roof (hereinafter, "trussed roof"). However, there is a problem that the conventional heliport 100 cannot be placed on such a trussed roof. That is, when the beams 120 are provided on the trussed roof and the deck materials 110 are bedded on the beams, the loads may concentrate on part of the beams 120 due to the impact load and the concentrated load peculiar to heliport. This leads to buckling and the like in the construction members of the trussed roof. Furthermore, when a heliport is constructed on a structure other than a trussed roof, such as a trussed structure, a crib structure or another frame structure, a similar problem arises. Therefore, in the present invention, a heliport is constructed using a planar member formed by arranging and joining a plurality of the long deck materials, and then placing the planar member on a structure with low strength. The planar member has constant flexural rigidity in the planar direction due to the joining of the deck materials. This distributes the perpendicular load acting on the planar member, resulting in an advantage of reducing damage of the frame structure.

A heliport according to still another aspect of the present invention includes a planar member that is formed by arranging and joining together a plurality of long deck materials to form a surface having an approximately plane structure, and a predetermined placement surface on which the planar member is placed. The planar member functions as a top surface of a heliport surface or as a foundation for the heliport.

In recent years, demands have been made for a simple heliport for emergency that can be placed on bumpy ground or the like. However, even though the beams 120 are provided on such ground, parallelism between the beams 120 cannot be ensured, which leads to a problem that a flat heliport surface H cannot be constructed. Therefore, in the present invention, a plurality of the long deck materials are arranged and joined to form a planar member, and a heliport is constructed on the planar member as the foundation or on the top surface of the planar member. This leads to an advantage that a flat heliport can easily be constructed on a bumpy surface.

Engagement portions are provided along widths of the deck materials. The engagement portions of adjacent deck materials are engaged to join the adjacent deck materials by engaging the engagement portions directly, or indirectly via an intermediate member inserted in the engagement portions.

In the above invention, an engagement portion is provided on the side face of the deck material. The adjacent deck materials are directly engaged in each other and joined, or the adjacent deck materials are indirectly joined via an intermediate member engaged in the engagement portions. The engagement portion provides constant flexural rigidity between the adjacent deck materials by direct or indirect engagement. This manner gives an advantage that the planar member is easily assembled as well as strength for the perpendicular load increases, compared to when joined with bolts and the like. The engagement portions, for example, are provided on the sides corresponding to the adjacent deck materials, and include a depression portion and a projection portion to be engaged in each other.

The deck material includes a hollow portion with openings on both ends. A first deck material is connected to a second deck material that is placed adjacent in a longitudinal direction, by inserting one end of a reinforcing member into the opening on one end of the hollow portion of the first deck material, and inserting another end of the reinforcing member into the opening on one end of the hollow portion of the second deck material.

In the above invention, each deck material includes a hollow portion and the deck materials are placed adjacent in the longitudinal direction. A reinforcing member is inserted into one end of the hollow portion of one deck material, and the other end of the reinforcing member is inserted into the hollow portion of another deck material adjacent to the former deck material in the longitudinal direction, and the adjacent deck materials are connected to each other. This allows reinforcement of the joint between the deck materials with the rigidity of the reinforcing member. This leads to an advantage of enhancing the flexural rigidity in the longitudinal direction of the planar member.

The deck material is integrally formed by extrusion molding in the longitudinal direction.

In the above invention, the deck material is integrally molded by extrusion molding in the longitudinal direction. This leads to an advantage that the deck material can be formed in a single process at a time. Moreover, the deck material has weight and dimensions such that a person can carry the deck material. Thus, a worker can assemble the heliport. Therefore, there is an advantage that the heliport can be constructed with a labor-intensive method under the circumstances where, for example, a crane cannot be used for carrying the deck materials. The weight and the dimensions of the deck material are preferably within the range of weight and dimensions of the deck material that can be carried by one or two workmen in view of workability.

In the heliport, a plurality of the planar members are layered with face-to-face contact with one another.

In the above invention, plural planar members are layered in a state of face-to-face contact. This leads to an advantage of an increase in strength of the heliport, and rattling between the planar members is prevented. The constructions in which the planar members are layered include a construction in which a groove is provided on each opposing face of a pair of the planar members joining pieces are inserted into the grooves, and the planar members are joined via the joining pieces to thereby form layers. In such a construction, the joining piece is easily detachable, which leads to an advantage of easy layering of the planar members for assembly. The grooves are provided along the length of the deck materials forming the planar member, and are integrally molded by extrusion molding at the time of formation of the deck material. Thus, the groove can be formed at the same time that the deck material is formed, resulting in an advantage of omitting a separate process to form the groove.

The heliport member according to the present invention is constructed by arranging and joining a plurality of the long deck materials, has an approximately plane structure, and also forms the heliport surface or the foundations of the heliport.

A building and construction member includes arranging a plurality of long deck materials in a plane, joining the deck materials to one another to form a single piece having approximately plate-like structure, and placing the single piece formed, on a supporting member to form a plane surface.

The planar member is not crimped at the joints due to the interjoining between the deck materials, which allows the planar member to have a constant flexural rigidity in the planar direction. Therefore, the planar member distributes the concentrated load received from the plane surface of the planar member, and transfers the load to the supporting means below. This leads to an advantage that, a plane surface can be constructed on a supporting means with a relatively low strength such as space framework or other frame structures.

Engagement portions are provided along widths of the deck materials. The engagement portions of adjacent deck materials are engaged to join the adjacent deck materials by engaging the engagement portions directly, or indirectly via an intermediate member inserted in the engagement portions.

In the above invention, an engagement portion is provided on the side face of the deck material. The directly adjacent deck materials are engaged in each other at the engagement portions and joined, or the adjacent deck materials are indirectly joined to each other via the intermediate member inserted in the engagement portions. Engaging the engagement portions directly or indirectly makes it possible to provide constant flexural rigidity between the deck materials adjacent to each other. This leads to advantages that the planar member is easily assembled and the strength of the planar member to the perpendicular load is enhanced, compared to when joined with bolts and the like. The engagement portions, for example, are provided on the sides corresponding to the adjacent deck materials, and include a depression portion and a projection portion to be engaged in each other.

The deck material includes a hollow portion with openings on both ends. A first deck material is connected to a second deck material placed adjacent in a longitudinal direction, by inserting one end of a reinforcing member into the opening on one end of the hollow portion of the first deck material, and inserting another end of the reinforcing member into the opening on one end of the hollow portion of the second deck material.

In the above invention, each deck material includes a hollow portion and the deck materials are placed adjacent in the longitudinal direction. The reinforcing member is inserted into one end of the hollow portion of one deck material, and the other end of the reinforcing member is inserted into the hollow portion of another deck material adjacent to the former deck material in the longitudinal direction, and the adjacent deck materials are connected to each other. This allows reinforcement of the joint between the deck materials with the rigidity of the reinforcing member. This leads to an advantage of enhancing the flexural rigidity in the longitudinal direction of the planar member.

In the building and construction material, the deck material may be integrally molded by extrusion molding in the longitudinal direction. This leads to an advantage that the deck material can be formed in a single process at a time. Moreover, the deck material has weight and dimensions such that a person can carry the deck material. Thus, a worker can assemble the heliport. Therefore, there is an advantage that the heliport can be constructed with a labor-intensive method under the circumstances where, for example, a crane cannot be used for carrying the deck materials. The weight and the dimensions of the deck material are preferably within the range of weight and dimensions of the deck material that can be carried by one or two workmen in view of workability.

In the building and construction material, a structure in which plural planar members are layered in a state of a face-to-face contact to one another may be employed. This leads to an advantage of an increase in the strength of heliport, and rattling between the planar members is prevented. The constructions in which the planar members are layered include a construction in which a groove is provided on each opposing face of a pair of the planar members, joining pieces are inserted into the grooves, and the planar members are joined via the joining pieces to thereby form layers. In such a construction, the joining piece is easily detachable, which leads to an advantage of easy layering of the planar members for assembly. The grooves are provided along the length of the deck materials forming the planar member, and are integrally molded by extrusion molding at the time of formation of the deck material. Thus, the groove can be formed at the same time that the deck material is formed, resulting in an advantage of omitting a separate process to form the groove.

A building and construction member includes arranging a plurality of long deck materials in a plane, joining the deck materials to one another to form a single planar member having approximately plate-like structure.

BEST MODE FOR CARRYING OUT THE INVENTION

Exemplary embodiments of the heliport and the building and construction member will be explained in detail with reference to the accompanying drawings. However, the present invention is not limited by the embodiments below. The following constituent features of the embodiments include elements substitutable and easy to substitute by those skilled in the art or substantially the same ones.

Figure 1:
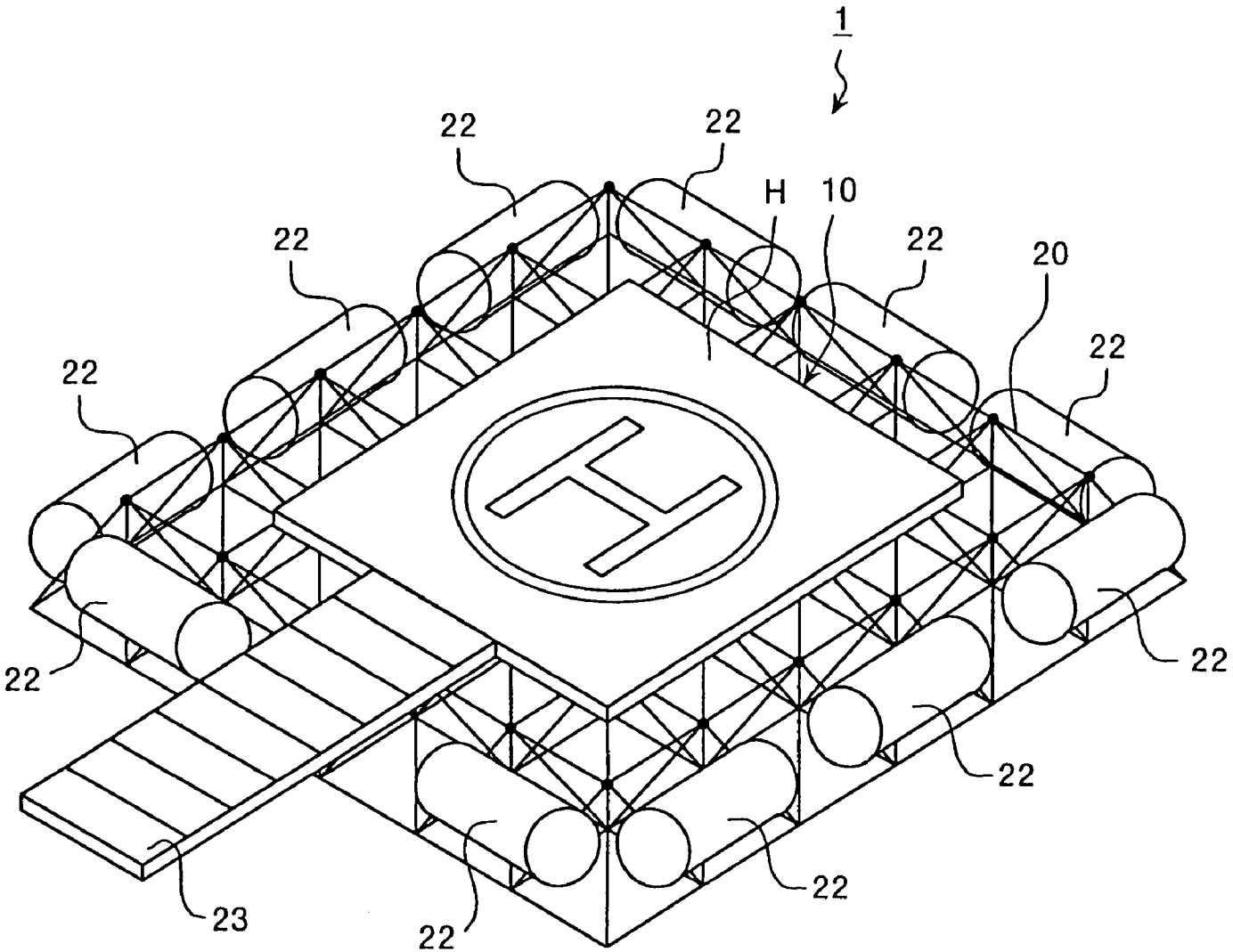
FIG. 1 is a perspective of a heliport according to a first embodiment of the present invention.
Figure 2:
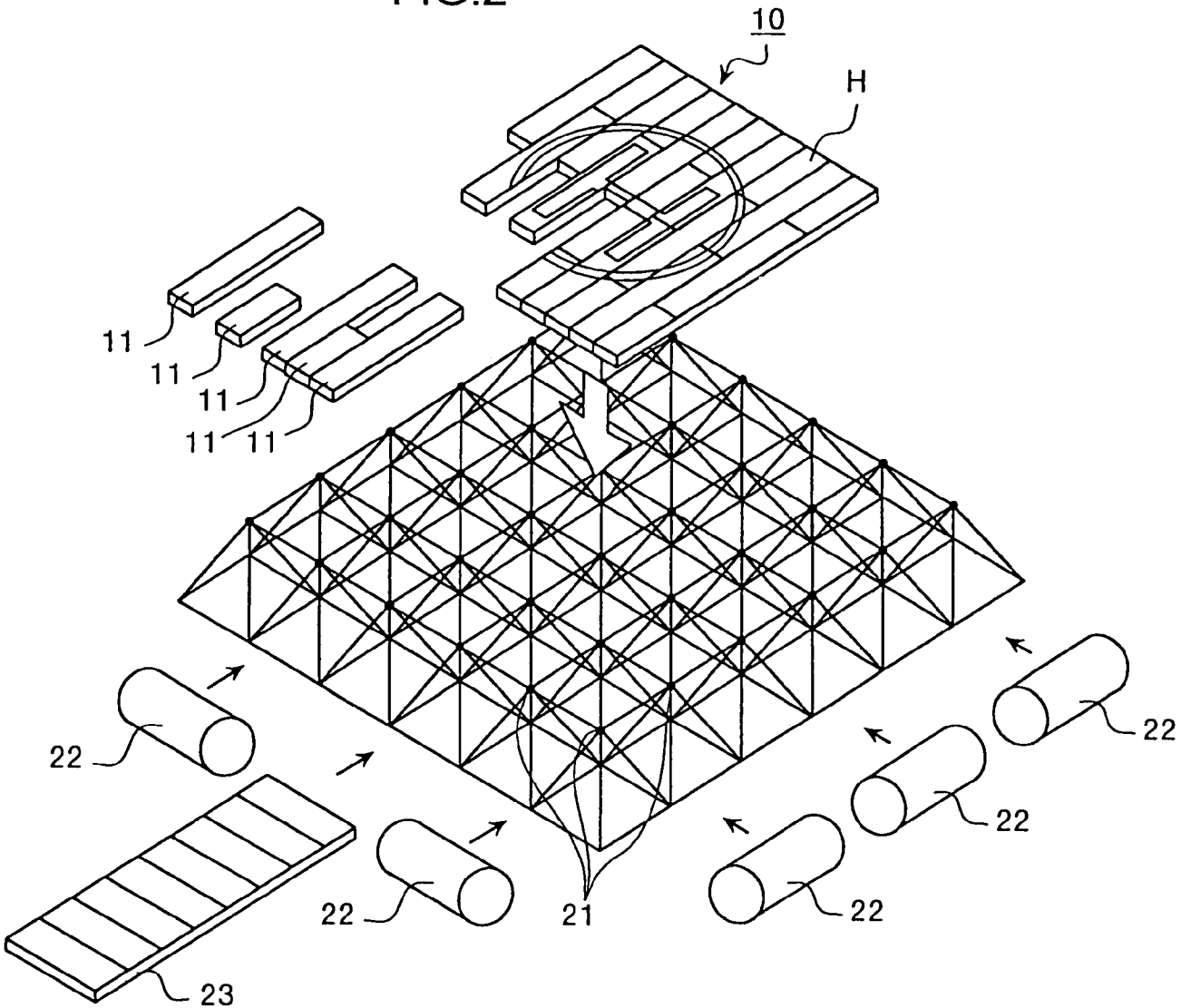
FIG. 2 is a perspective assembly of a structure of a planar member illustrated in FIG. 1.

FIG. 1 is a perspective of a heliport according to a first embodiment of the present invention. FIG. 2 is a perspective assembly of a structure of a planar member illustrated in FIG. 1. The heliport 1 includes a planar member 10 and a space framework 20. The planar member 10 is constructed by joining a plurality of long deck materials 11 that are made of aluminum to form a single piece of approximately plate-like structure. There are long and short deck materials 11, and the planar member 10 is constructed by assembling the long and short deck materials lengthwise and breadthwise to form an approximately square shape. The deck material 11 is made of aluminum, and hence, maintains the strength as well as reduces the weight of the heliport 1. Specifically, the long deck material 11 weighs 30 kg and the short deck material 11 weighs 15 kg. An adult can carry the deck material 11.

Figure 3:
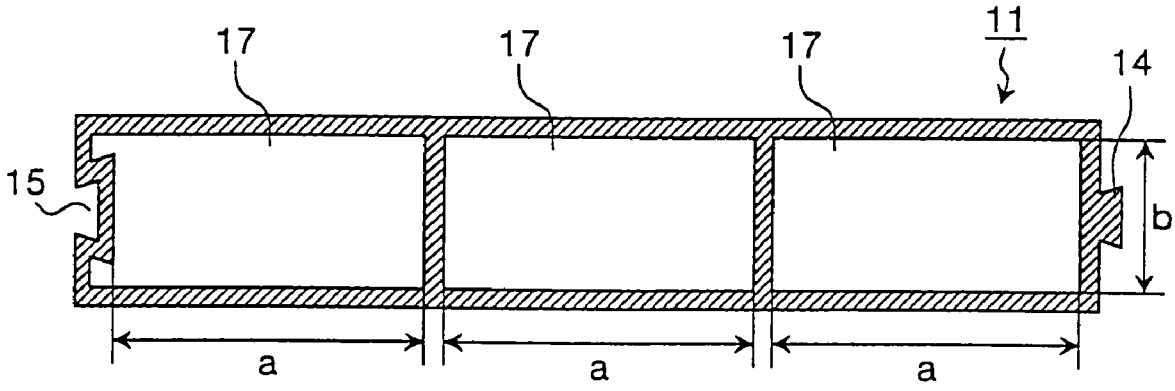
FIG. 3 is a cross section of a deck material that constitutes the planar member.
Figure 4:
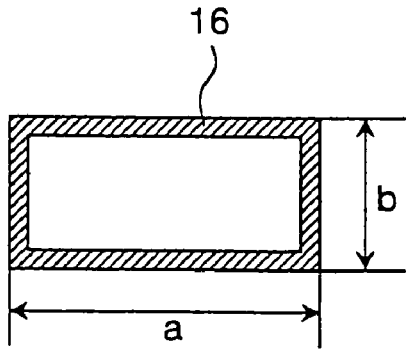
FIG. 4 is a cross section of a reinforcing member of the deck material.

FIG. 3 is a cross section of the deck material that constitutes the planar member. FIG. 4 is a cross section of a reinforcing member of the deck material. In FIG. 3, the deck material 11 has a rectangular hollow structure in cross section, and is uniformly formed in the longitudinal direction in an extrusion processing. The deck material 11 has a projection portion 14 on one side face of the width direction and a depression portion 15 on the other side face. The projection portion 14 and the depression portion 15 are integrally formed when the deck material 11 is constructed by extrusion processing. The projection portion 14 and the depression portion 15 can be fixedly engaged in each other due to their dovetail structures. The reinforcing member 16 shown in FIG. 4 is a rectangular aluminum pipe, and is inserted into a hollow portion 17 of the deck material 11 to reinforce the deck material 11. Each cross section of the hollow portion 17 has an identical dimension (see FIG. 3). This leads to an advantage that the deck material 11 can be reinforced with only one kind of the reinforcing member 16.

Figure 5:
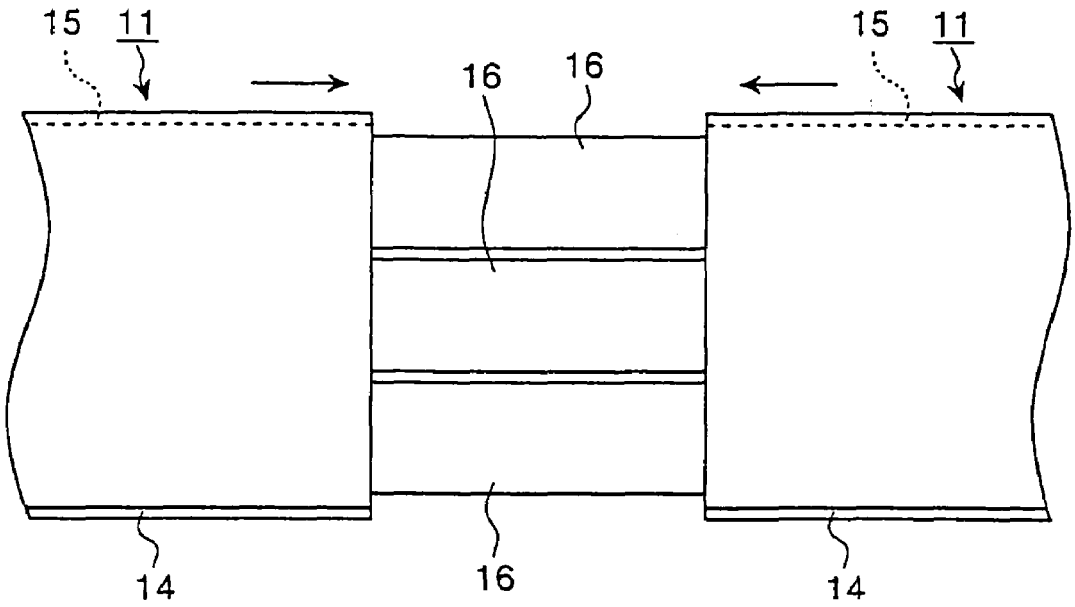
FIG. 5 illustrates how the deck materials are joined in a longitudinal direction.
Figure 6:
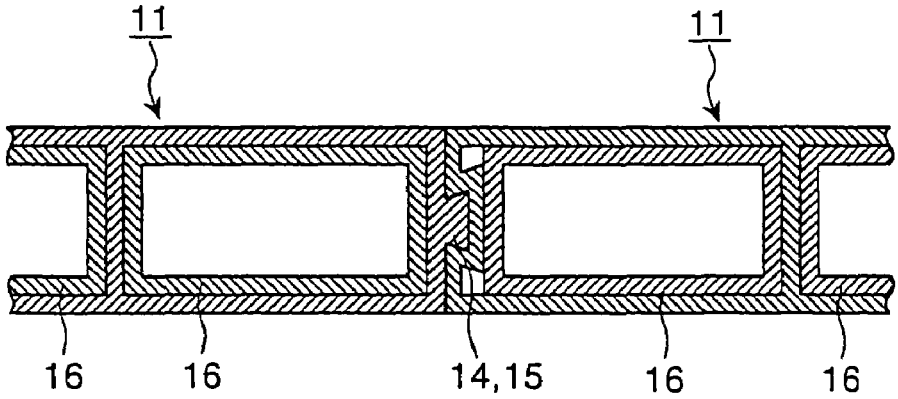
FIG. 6 illustrates how the deck materials are joined in a width direction.

FIG. 5 illustrates how the deck materials are joined in a longitudinal direction. The deck materials 11, 11 adjacent in the longitudinal direction are connected to each other via the reinforcing members 16. Each of the reinforcing members 16 is inserted in the hollow portions 17 of the deck material 11 by half of the length of the reinforcing member 16. The deck materials 11, 11 form one bar-shaped member having a flexural rigidity with the use of the reinforcing members 16. FIG. 6 illustrates how the deck materials are joined in a width direction. To join the deck materials 11, 11 adjacent to each other in the width direction, the depression portion 15 and the projection portion 14 on the side faces are inserted from the longitudinal direction, thereby engaging the deck materials 11, 11 in each other. At this time, the adjacent deck materials 11 are moved apart by half of the length in the longitudinal direction and joined together (see FIG. 2). The projection portion 14 and the corresponding depression portion 15 in a joining state are securely engaged in each other so that the deck materials 11, 11 joined together do not elbow at the joint. Thus, the deck materials 11 joined in the longitudinal direction and the width direction form the planar member 10.

Figure 20:
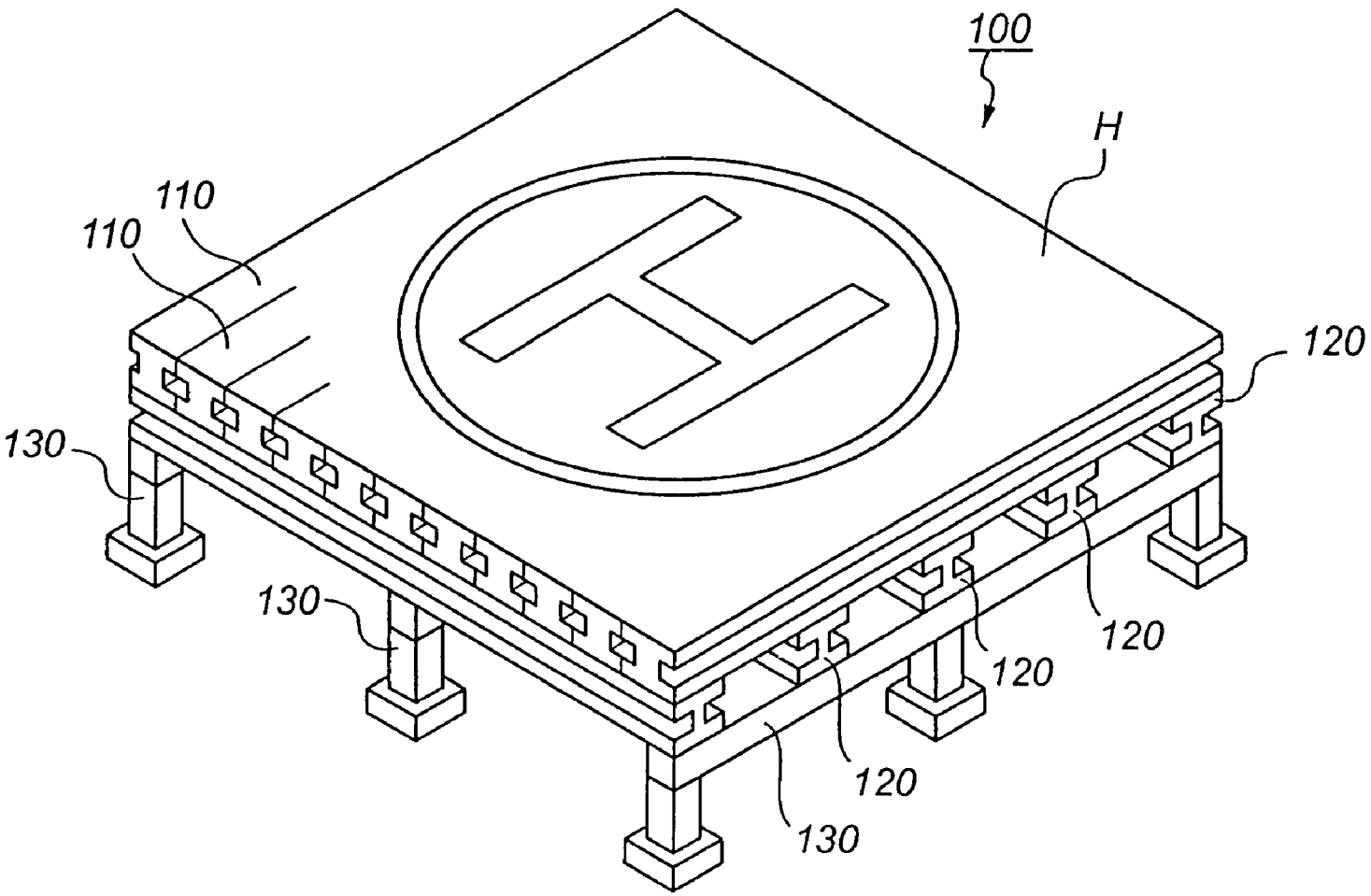
FIG. 20 is a whole structural drawing of a conventional heliport.
Figure 21:
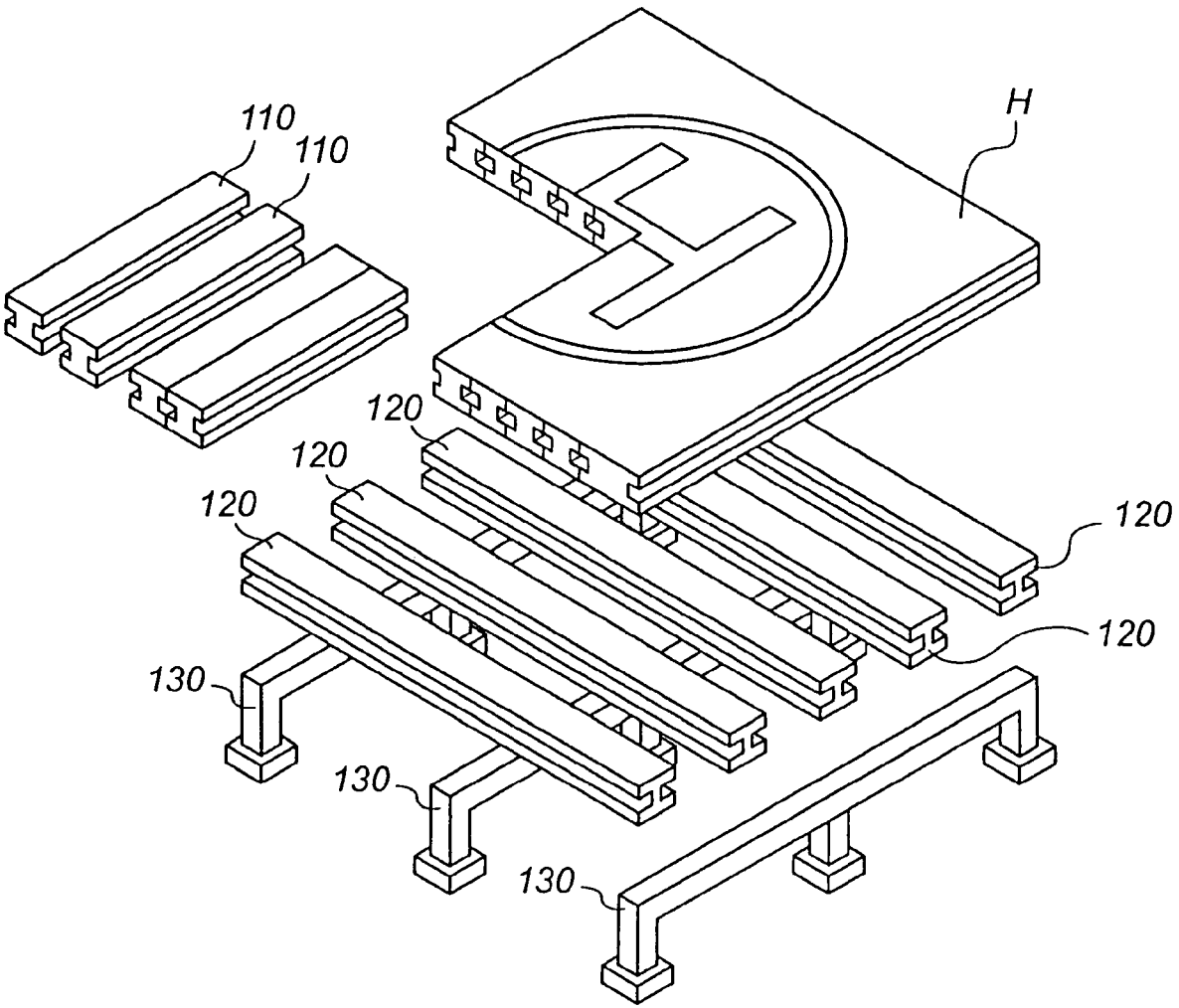
FIG. 21 is a perspective assembly view of the conventional heliport.

The planar member 10 is placed on the space framework 20 and the top surface of the planar member 10 forms a heliport surface H on which a helicopter takes off and lands (see FIGS. 1 and 2). Due to the joining method described above, the planar member 10 functions as a single piece of plate-like structure, and distributes the concentrated load and the impact load received from the heliport surface H and transfers the load to the space framework 20 below. Thus, the load acting on the planar 10 is distributed. Consequently, a shaft force of the space framework 20 reduces, as compared to that in the structure in which the beams 120 are provided on the space framework 20 and the deck materials 110 are bedded on the beams '(see FIGS. 20 and 21)'. Thus, buckling of the pipe materials to form the space framework 20 suppresses. This leads to an advantage that a heliport can be set up on a structure that is weaker and less brittle or has poor rigidity for the concentrated load. Another advantage is that the heliport 1 can be provided at any desired place, because the planar member 10 is easy to assemble by engaging the deck materials 11 and the reinforcing members 16.

The space framework 20 is constructed by assembling a plurality of pipe materials and is an approximately box shape. In particular, the space framework 20 consists of pipe materials that can be carried by a person, and specifically, can be assembled manually by workers. Thus, this results in an advantage that the space framework 20 can be set up at any desired place by delivering the pipe materials. Moreover, a plurality of floats 22 are attached to the space framework 20 on its outer peripheral sides, and the space framework 20 floats on water by the buoyancy of the floats 22, thereby forming the foundation of the heliport 1. The heliport 1 is easily constructed on water by placing the planar member 10 on the space framework 20. Particularly, such a floating-type heliport 1 is useful when there is no space at a coastal site to provide a heliport. The space framework 20 is provided with a pier 23 to connect land to the heliport 1, thereby making it possible for people to get on or get off. In some cases, additional floats (not shown) may be attached to the bottom of the space framework 20 and the pier 23.

Figure 7:
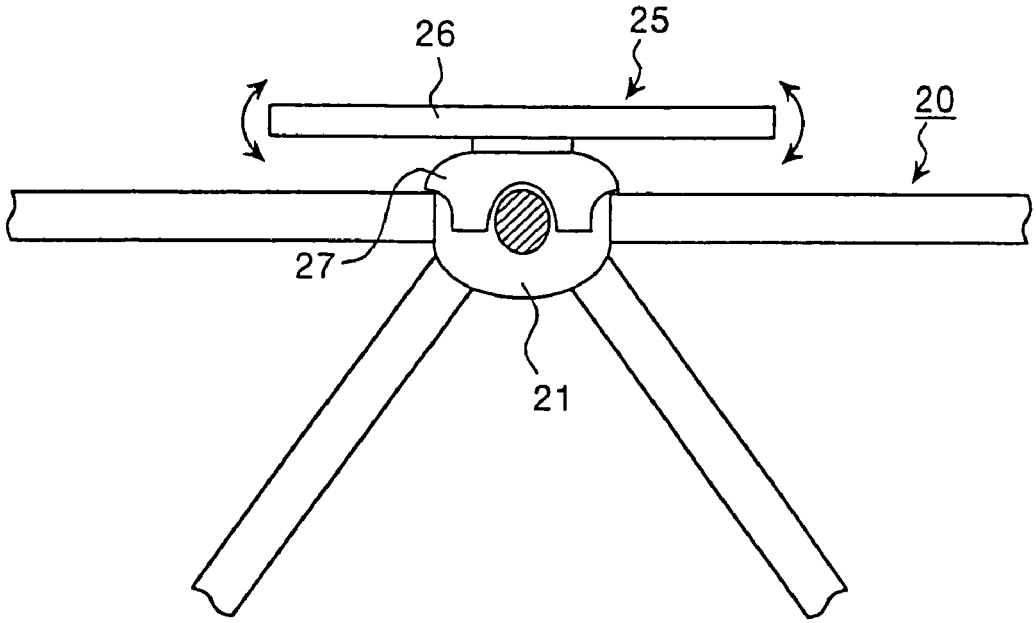
FIG. 7 is a perspective that illustrates how a cramp is arranged.

The planar member 10 is placed on the space framework 20 with the use of cramps. FIG. 7 is a perspective that illustrates how a cramp is arranged. The cramp 25 has a surface portion 26 of a plate shape and a leg portion 27 in a spherical shell shape provided on a back surface of the surface portion 26. The cramp 25 is attached by engaging the leg portion 27 on the joining point 21 of the pipe materials that form the space framework 20. The planar member 10 is mounted on the surface portion 26 of the cramp 25, and fixed. The surface portion 26 is attached to the leg portion 27 in such a way that allows a slight rotatable displacement. Thus, the contact face of the surface portion 26 is rotatably displaced to secure the surface portion 26 to the back surface of the planar member 10.

In the first embodiment, the length of the deck material 11 is about 2000 millimeters (mm) for the long one and about 1000 mm for the short one. These lengths are preferred so that an average adult can carry the deck materials, and because the deck materials of these lengths are easy to construct in a typical extrusion process. However, the length is not limited to the above, and may be shorter, provided that the length is within a range in which the heliport 1 can be efficiently assembled. This leads to an advantage that the shorter the deck material 11 is, the more easily it is carried. On the other hand, if the deck material 11 is longer, an advantage is that a number of parts of the heliport reduces, assembling is easier. In the first embodiment, the weight of the long deck material 11 is preferably set to about 30 kg, because a man of trained under the Self-Defense Forces can carry an object weighing 30 kg. However, the weight is not limited to the above. The weight of the deck material 11 may be reduced further as long as its strength is ensured. This leads to an advantage that ordinary people can easily carry the deck material 11.

In the first embodiment, a projection portion 14 and a depression portion 15 are provided on the side faces of the deck material 11, and are engaged in each other in a dovetail structure. This structure enables easy assembly of the planar member 10, compared to when joined by bolt binding or the like. The advantage of the dovetail structure is to prevent the separation of the deck materials 11, 11 from each other due to tension in the planar direction. However, the structure is not limited to the above, but other structures that are well known or obvious to those skilled in the art may be employed for the engagement portion or the engagement structure of the deck material 11.

Figure 8:
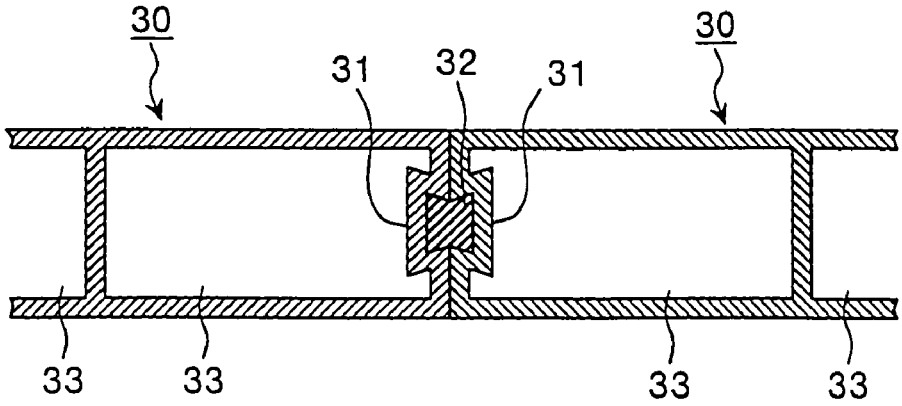
FIG. 8 is a cross section of a modification example of an engagement structure.

FIG. 8 is a cross section of a modification example of the engagement structure. Both side faces of the deck materials 30 facing each other are provided with depression portions 31, and an intermediate member 32 is inserted between the depression portions 31, 31. This structure may be acceptable for engagement of the deck materials 30, 30. In such a structure, the deck materials 30, 30 are arranged at the predetermined position, and then the intermediate member 32 is inserted to engage them, thereby joining the deck materials 30, 30 to each other. This leads to an advantage that the planar member 10 can be assembled more easily as compared to sliding each heavy deck material 11 to engage in each other, because it is not necessary to move the deck materials from the arrangement position. Particularly, in a modification example of the heliport 1 described later, the assembly of the planar member is more complicated than that of the present first embodiment in view of the structure in which the planar members are multi-layered. In this aspect, according to the assembly mode with the use of the intermediate members 32, the deck materials are first arranged in layers, and then joined to each other to form the planar member. The advantage of this method is that a heliport can be assembled more easily. The reinforcing member 16 is inserted into a hollow portion 33 of the deck material 30 in the first embodiment.

In the first embodiment, the area of the plane portion of the planar member 10 is less than that of the space framework 20. The floats 22 are attached to the outer periphery of the space framework 20 (see FIG. 1). Accordingly, the load to be received on the heliport surface H is supported over a wide span between the floats 22 via the space framework 20. The advantage of such structure is that the heliport 1 rarely overturns.

Figure 9:
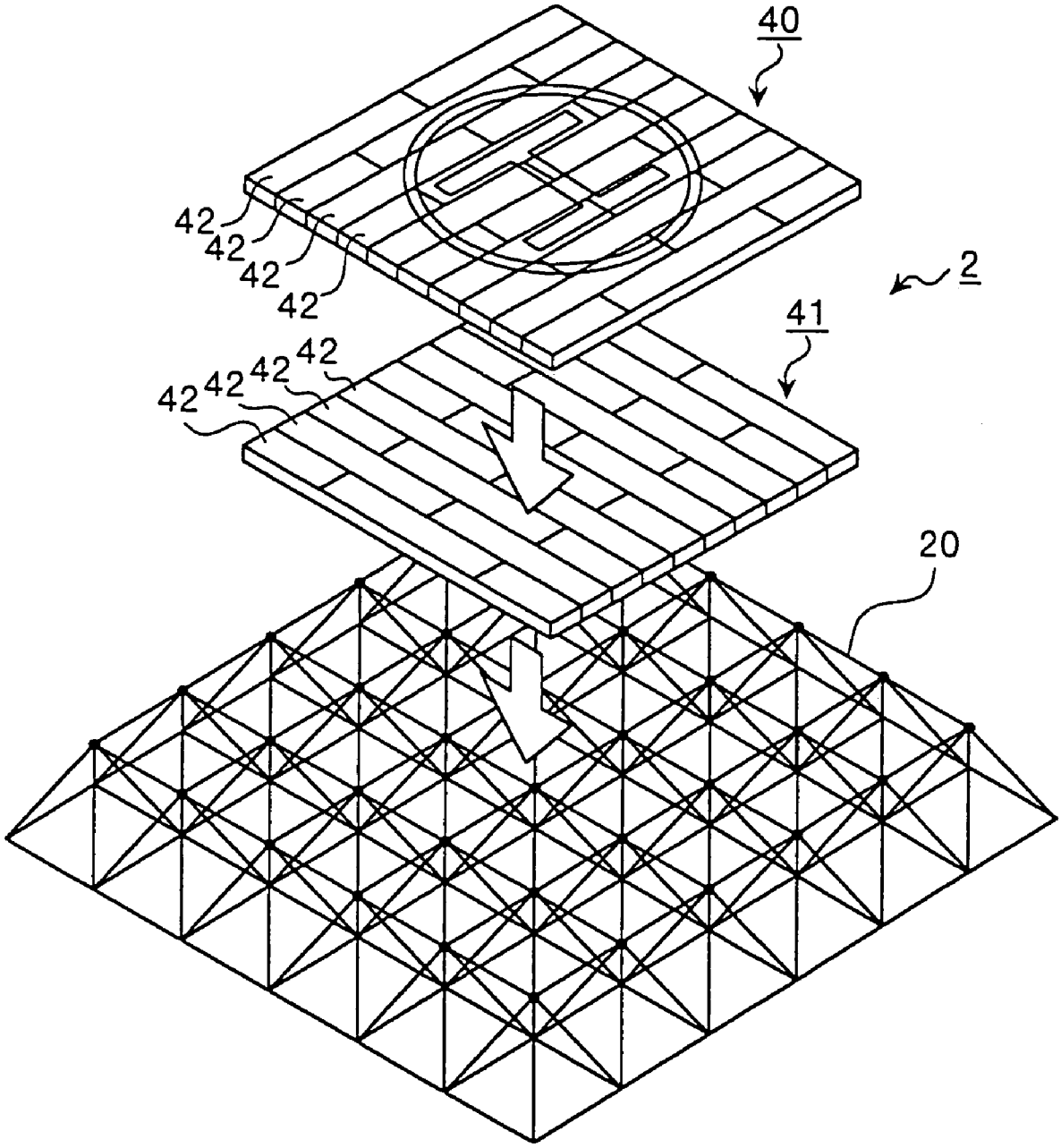
FIG. 9 is a structural drawing of the heliport according to a first modification example of the first embodiment.

FIG. 9 is a structural drawing of the heliport according to a first modification example of the first embodiment. In FIG. 9, the same numerals are used for the same elements as those of the first embodiment, and the explanation thereof is omitted. The heliport 2 differs from the structure of the heliport in the first embodiment in that the heliport 2 has a double layered-structure where the planar members 40, 41 are layered. That is, in the structure of the heliport 2, the lower planar member 41 is placed on the space framework 20, and then the upper the planar member 40 is layered on the lower planar member 41. The upper planar member 40 and the lower planar member 41 have an approximately identical shape and an approximately identical structure. The deck materials 42 that constitute one planar member are layered orthogonally to the deck materials 42 that constitute the other planar member. The double-layered structure and the orthogonal structure have an advantage of enhancing the rigidity of the heliport 2 to the peculiar concentrated load and impact load. The lower planar member 41 is installed on the space framework 20 with the use of the cramps 25 in a manner similar to that in the first embodiment. Moreover, with the floats 22 and the pier 23 (not shown) attached to the space framework 20, the heliport 2 floats on water.

Figure 10:
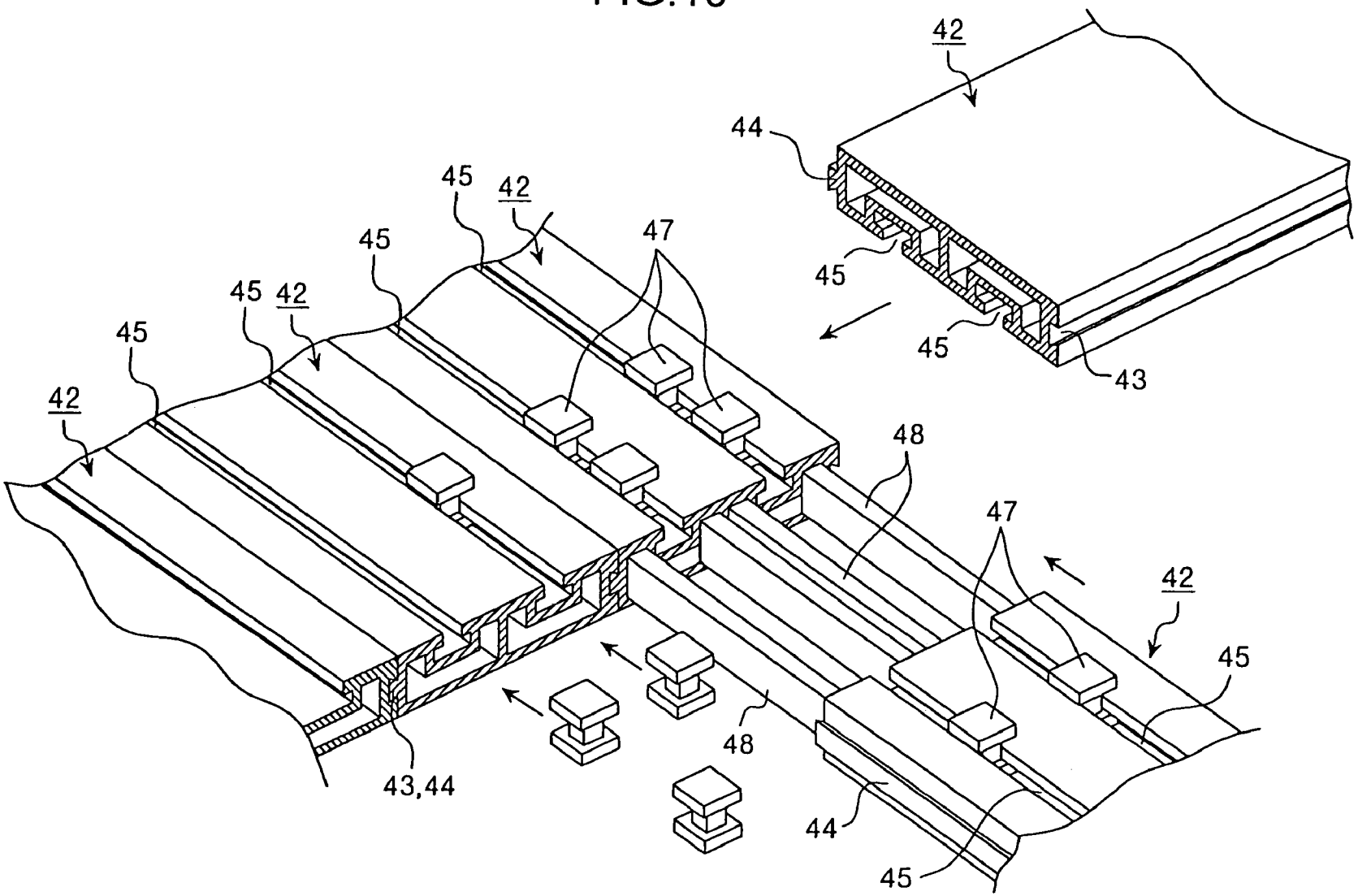
FIG. 10 is a perspective assembly of the planar member illustrated in FIG. 9.
Figure 11:
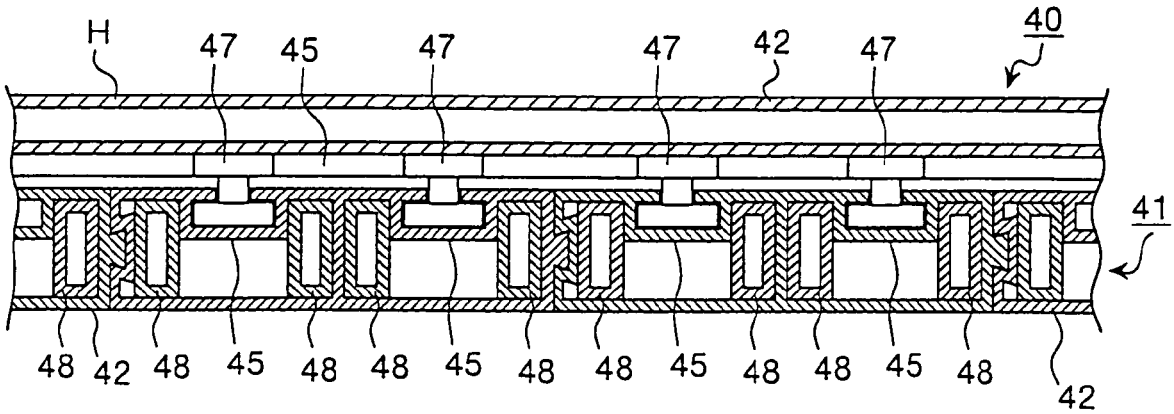
FIG. 11 is a cross section of the planar member illustrated in FIG. 9.
Figure 12:
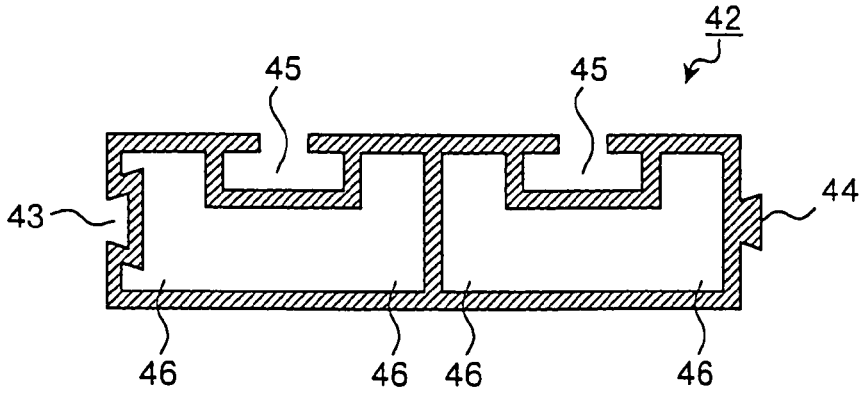
FIG. 12 is a cross section of a deck material.
Figure 13:
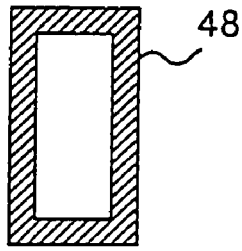
FIG. 13 is a cross section of a reinforcing member.
Figure 14A:
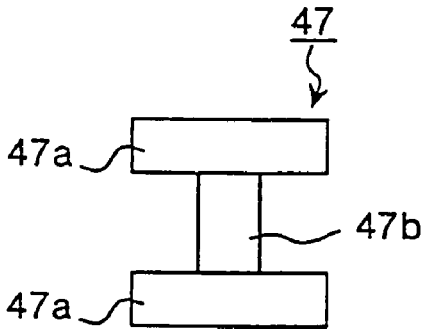
FIG. 14A is a front view and FIG. 14B is a plan view of a joining piece.
Figure 14B:
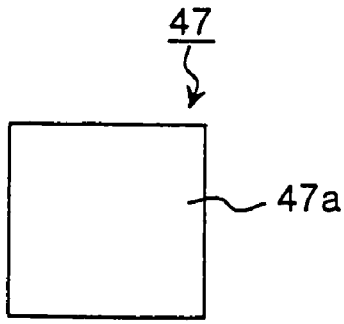

FIGS. 10 and 11 are a perspective assembly and a cross section, respectively, of the planar member illustrated in FIG. 9. FIG. 12 is a cross section of the deck material. FIG. 13 is a cross section of a reinforcing member. FIG. 14A is a front view and FIG. 14B is a plan view of a joining piece. The deck material 42 is a long aluminum member, has a hollow structure and is formed in an extrusion processing to have a uniform cross section in the longitudinal direction (see FIG. 12). The deck material 42 has a depression portion 43 on one side and a projection portion 44 on the other side of the plane direction. The depression portion 43 and the projection portion 44 are engaged to serve as engagement portions, and the engagement portions allow joining adjacent deck materials 42 to one another in the width direction. In addition, aluminum-reinforcing members 48 (see FIG. 13) are inserted into the hollow portions 46 of the deck material 42. The deck material 42 is connected to another deck material 42 in the longitudinal direction via the reinforcing members 48 (see FIG. 10). In this manner, the deck materials 42 are joined lengthwise and breadthwise to form the planar members 40, 41 having a single plate-like structure. The connection structure of the planar members 40, 41 is the same as that of the first embodiment. Moreover, both the planar members 40, 41 are constructed using identical deck materials 42. Therefore, the advantage is that only one kind of the deck material made by an extrusion process is sufficient.

Compared to the deck material 11 of the first embodiment, the deck material 42 is characteristic in that two rail portions 45, 45 are provided along the length on the upper portion of the deck material 42 (see FIGS. 10 and 12). A plurality of joining pieces 47 is set in the rail portions 45. As shown in FIG. 14, the joining piece 47 has a pair of plate-like portions 47*a*, 47*a*of a square shape and a shaft portion 47*b* to connect the two facing sides of the plate-like portions 47*a*, 47*a*. The upper planar member 40 and the lower planar member 41 are joined to each other via the joining pieces 47. When the upper planar member 40 and the lower planar member 41 are joined, the lower planar member 41 is first assembled and placed on the space framework 20. Next, one plate-like portion 47*a* of 'the joining piece 47' is inserted from the leading end of the rail portion 45 of the deck material 42 that forms the lower planar member 41, such that the other plate-like portion 47*a* protrudes from the rail portion 45, and the joining pieces 47 are arranged at predetermined positions (see FIG. 10).

Next, the deck materials 42 that form 'the upper planar member 40' are arranged on the lower planar member 41 that is already set. At this time, the deck material 42 is arranged by allowing it to slide from the upper lateral side of the lower planar member 41, with sequentially inserting a plurality of the plate-like portions 47*a* of the joining pieces 47 that protrude from the lower planar member 41 into the rail portions 45 of the deck material 42. In this manner, the deck materials 42 of 'the upper planar member 40' are joined to the lower planar member 41 via the joining pieces 47 (see FIG. 11). Next, the deck materials 42 are sequentially arranged to assemble the upper planar member 40 on the lower planar member 41. Thus, the heliport surface H is constructed by double layering the planar members 40, 41. In the joined state, the planar members 40, 41 have a face-to-face contact. That is, the length and other dimensions of the shaft portion 47*b* of the joining piece 47 are designed such that the planar members 40, 41 are in such a joining state. The joining between the planar members 40, 41 is enhanced by such a face-to face contact, resulting in an advantage of further enhancing the rigidity of the heliport 2.

The the plate-like portion 47*a* of the joining piece 47 is square shaped in the first modification example. Therefore, due to the orthogonal sides of the square, the upper and the lower deck materials 42, 42 are fixed to each other orthogonally. Such a structure restrains the rotational displacement of the deck materials 42, 42, resulting in an advantage that the planar members 40, 41 are joined to each other securely. However, the shape of the plate-like portion 47*a* of the joining piece 47 is not limited to the above. Other shapes, for example, a regular hexagonal shape and a circular shape are acceptable. If the shape of the plate-like portion 47*a* is a regular hexagon, the joining angle between the upper and lower deck materials 42, 42 is restrained to about 60 degrees. This is preferred, for example, if the planar members are layered while crossing each other at 60 degrees, as described later for a heliport 3 of a second modification example (the drawing omitted). Moreover, when the shape is a circle, there is an advantage that it is possible to alter the joining angle between the deck materials 42, 42 as desired.

Figure 15:
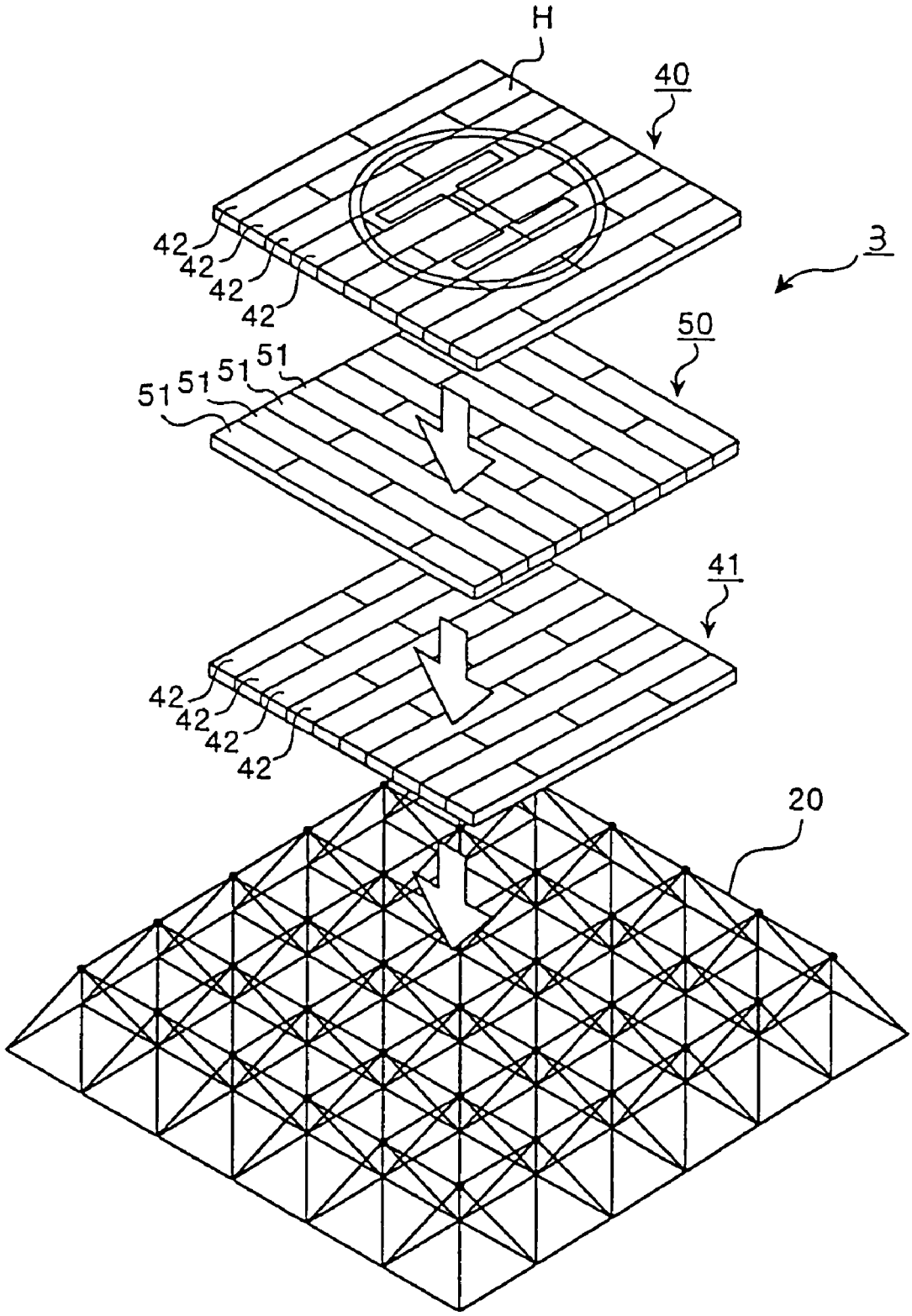
FIG. 15 is a structural drawing of the heliport according to a second modification example of the first embodiment.

FIG. 15 is a structural drawing of the heliport according to a second modification example of the first embodiment. In FIG. 15, the same numerals for the same structural elements as those of the first embodiment and the first modification example are used, and the explanation thereof is omitted. The heliport 3' characteristically has a triple-layered structure in which an intermediate planar member 50 is further provided between the planar members 40, 41 compared with the structure of the heliport 2 of the first modification example. That is, the heliport 3 is formed by providing the lower planar member 41 on the space framework 20, providing the intermediate planar member 50 on the lower planar member 41, and further providing the upper planar member 40 on the intermediate planar member 50. These planar members 40, 41 and 50 are layered with the arrangement directions of the deck materials 42, 50 orthogonal to each other, resulting in enhancement of the strength of the heliport 3.

Figure 16:
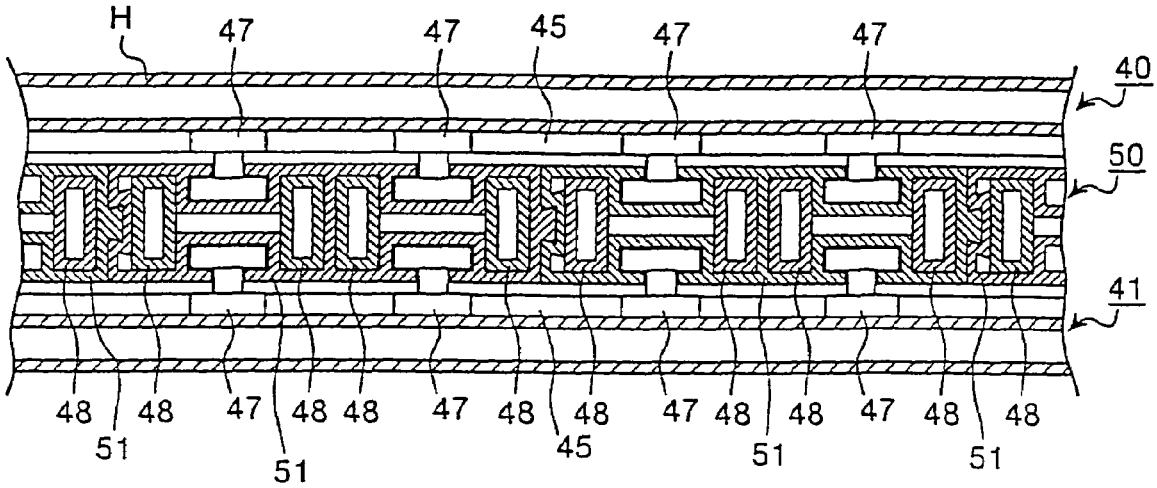
FIG. 16 is a cross section of a layered state of the planar members illustrated in FIG. 15.
Figure 17:
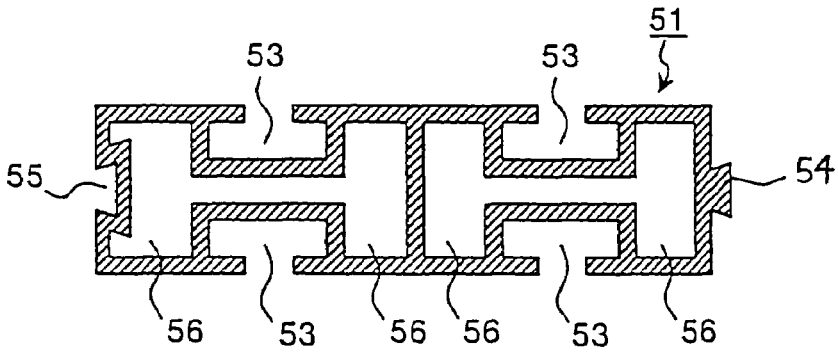
FIG. 17 is a cross section of the deck material that forms an intermediate planar member.

FIG. 16 is a cross section of the layered state of the planar members illustrated in FIG. 15. FIG. 17 is a cross section of the deck material that forms the intermediate planar member. As compared with the deck material 42 of the first modification example, the deck material 51 includes rail portions 53, in which the joining pieces 47 are inserted, and which are provided characteristically on both faces of the deck material 51 (see FIG. 17). The deck material 51 is joined to other deck materials 51' adjacent in the width direction, using a projection portion 54 provided on one side face and at a depression portion 55 provided on the other side face. The deck material 51 is connected to another deck material 50 adjacent in the longitudinal direction, by inserting reinforcing members 48 into the hollow portions 56 of the deck materials 50 and 51. Thus, the deck materials 51 form the intermediate planar member 50 having a single piece of approximately plate-like structure. The intermediate planar member 50 is joined to the upper planar member 40 and the lower planar member 41, with face-to face contact, via the joining pieces 47 inserted into the rail portions 53. This leads to an advantage of enhancing the joining strength among the planar members 40, 41 and 50. The assembly mode of the planar members 40, 41 and 50 is the same as that of the deck materials 42 of the first modification example. Specifically, the lower planar member 41 is assembled on the space framework 20 and the deck materials 51 are sequentially arranged to assemble the intermediate planar member 50. On this intermediate planar member 50, the upper planar member 40 is assembled to form the heliport surface H. In the second modification example, the three planar members 40, 41 and 50 are layered. However, a plurality of the planar members may be further layered with the use of a similar layering mode.

In the first embodiment, the planar member 10 is provided on the space framework 20 floating on water to form the heliport 1, but the application of the planar member 10 is not limited thereto. There are some cases where, for example, buildings such as a gymnasium and a warehouse in which a distance between columns is large, and have a trussed roof with a point of view of strength. However, there is a problem that the conventional heliport 100 cannot be placed on such a trussed roof. The reason for the difficulty is that if the beams 120 are provided on the trussed roof and deck materials 110 are bedded over the beams 120, the concentrated load and the impact load on the deck materials 110 act on part of the beams 120, which generates buckling in the trussed roof. In a second embodiment, the planar member 10 is placed directly on the trussed roof to form a heliport (the drawing omitted). The planar member 10 functions as a single piece of plate-like structure, and the loads acting on the heliport surface H are distributed and transferred to the trussed roof below. This restrains the buckling of the construction members, resulting in an advantage that a heliport can easily be provided on the trussed roof.

The planar member 10 of the second embodiment is mounted on the trussed roof with the use of the cramps 25. In addition, the planar member 10 may be constructed in a layered structure, similar to that in the first and the second modification examples. The place, on which the planar member 10 is set, is not limited to the trussed roof. That is, places such as the trussed roof that cannot tolerate the concentrated load and the impact load peculiar to a heliport, in other words, structures or buildings not suitable for the structure provided with the beams 120 may also be acceptable for placing the planar member 10. This leads to an advantage that a heliport can be constructed on a brittle or a less rigid structure.

To provide the heliport 1 in some existing buildings where a crane cannot be used, the beam 120, which is much longer than the deck material 11, cannot be carried to the roof. To overcome such a difficulty, the deck materials 11 of the planar member 10 have a weight and dimensions that can be carried by human strength. This leads to an advantage that a heliport can be constructed nevertheless, because, the deck materials 11 can be conveyed in another manner such as with the use of an elevator in the building.

In recent years, demands have been made for a simple heliport, provided on bumpy ground or a ground full of scattered debris, for use in an emergency situation. However, there is a problem that although the beams 120 are provided on such ground, parallelism between the beams 120 cannot be ensured, and hence, a flat heliport surface H cannot be constructed. However, the planar member 10 can be provided on such ground, and a heliport can be constructed (the drawing omitted). The planar member 10 functions as a single piece of plate-like structure. This leads to an advantage that a flat heliport surface H can be constructed even if the planar member 10 is provided on such bumpy ground.

In the first embodiment, the planar member 10 is used for the heliport 1, but the application of the planar member 10 is not limited thereto. For example, the planar member 10 may be used as floor material, roof material, wall material, board material of building or structures, and other construction material. Specifically, the planar member 10 may be used as building material for houses and buildings, as floor material for multilevel car parking tower, as civil engineering material for constructing bridges, as construction members of prefabrication-type simple bridges, and as deck material of ships and boats. For example, in conventional buildings, a floor or a roof is constructed by suspending a plurality of beams on the columns provided, and putting floor material or roof material over the beams. However, when the strength of the columns and beams are not sufficient to serve as the foundation, there is a risk of damage because of buckling or sheering due to the concentrated load. Therefore, the planar member 10 is used as the floor material or roof material, and placed on the beams. The planar member 10 is constructed by joining a plurality of the deck materials 11 to one another in the plane direction as described in the first embodiment, and the engagement construction of the planar member restrains crimps at the joining portions 14, 15. The planar member 10 functions as one piece of plate-like structure having significant strength, distributes the concentrated load acting on the surface, and transfers the load to the beams below. This leads to the advantage that the generation of the concentrated load can be controlled, thereby preventing damage to the columns and beams. Moreover, the planar member 10 is constructed by joining a plurality of the deck materials 11. This leads to an advantage that the length of one side can be adjusted, thereby constructing a plane surface of desired size. Therefore, for example, if the distance between the beams is more than the length of each deck material 11, the length of one side of the planar member 10 is extended according to the span. This leads to an advantage of constructing a floor without any problems. In particular, there are various cases where buildings are constructed temporarily in case of emergency, and an existing building is provided with a new floor or roof. In such cases, the length of building material that can be conveyed may sometimes be limited depending on the applicable methods of conveyance. In this respect, using the short deck materials 11 to construct the planar member 10 leads to an advantage that the planar member 10 can flexibly correspond to such a limitation.

FIRST EXAMPLE

Figure 18:
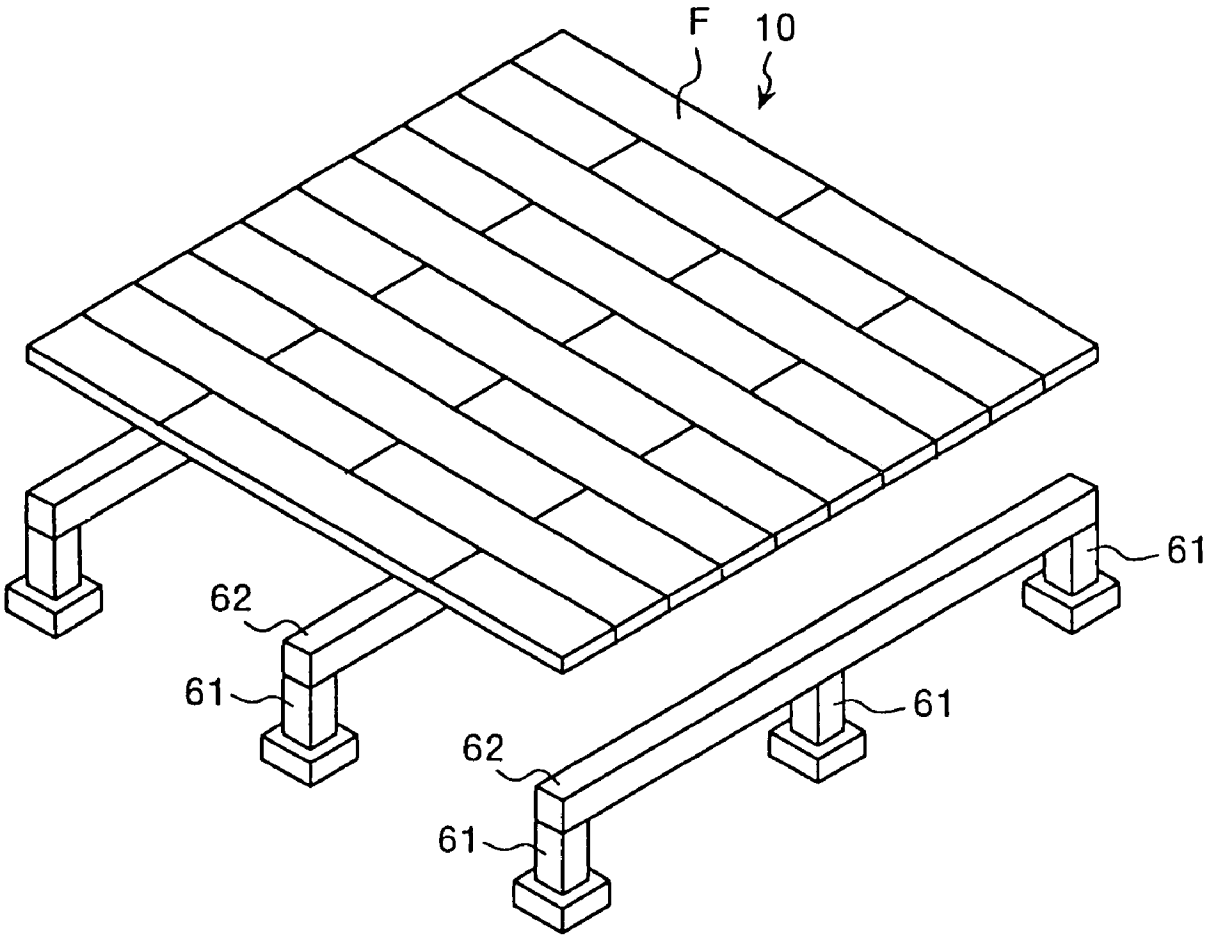
FIG. 18 is a structural drawing of an example application of the planar member.

FIG. 18 is a structural drawing of an example application of the planar member. In FIG. 18, the same numerals for the same structural elements as those of the first embodiment are used, and the explanation thereof is omitted. In FIG. 18, a plurality of beams 62 are put over columns 61 arranged with spacing. The planar member 10 is placed over the beams 62 to form a floor F of a building. The distribution action of the planar member 10 for the concentrated load as described above distributes the load acting on the surface, and transfers the load to the beams 62 below, to support the surface. This leads to an advantage that the load acting on the beams 62 is distributed, thereby preventing damage of the beams 62. Moreover, the shaft force acting on the columns 61 reduces, thereby preventing buckling of the columns 61 in some cases.

In this first example, when the strength of the building is to be further enhanced, the planar members 40, 41 and 50 that can be layered may be used in place of the planar member 10 (see FIGS. 9 to 17). When such planar members 40, 41 and 50 are used, the layered structure with the use of the joining pieces 47 allows the planar members 40, 41 and 50 to be securely held to one another in a face-to face contact state. This leads to an advantage that the strength of the floor of the building is further enhanced. The material for the deck material 11 that constitutes the planar member 10 is not limited to aluminum, but it may be appropriately changed depending on the application within the range that is obvious to those skilled in the art. For example, the deck material 11 may be made of butcher block, which is used for an ordinary building. In this first example, the beams 62 are arranged on the columns 61, and the planar member 10 is placed on the beams 62. However, the structure is not limited to the above, but the planar member 10 may be placed directly on the column materials 61. This leads to an advantage of omitting the beams 62. That is, the planar member 10 that functions as a single piece of approximately plate-like structure, can be placed directly on such columns 61.

For example, the planar member 10 is placed on the beam materials 62 as in the first example, whereas the planar member 10 may be placed on a space framework or another frame structure to form a floor or roof of a building (the drawing omitted). Specifically, the planar member 10 is suitable for a roof of gymnasium or warehouse. The planar member 10 has the action of load distribution. This leads to an advantage that the planar member 10 can be placed on foundations having a relatively low strength such as the frame structure.

In this first example, the planar member 10 is used as the floor F of building, but may be used as a roof of building in a structure similar to that of the floor F. The planar member 10 functions as one piece of plate-like structure, and has a load distribution function. Therefore, it has high structural strength compared to that of an ordinary roof member. Thus, the number of columns 61 and beams 62 to support the roof reduce. This leads to an advantage of constructing a larger floor. From a similar viewpoint, when the planar member 10 is used as, a floor material of a multilevel car-parking tower, the number of the columns 61 and beams 62 reduce. This leads to an advantage of ensuring a larger parking space. This advantage is particularly beneficial for Japan, where sufficient land allowance is insufficient.

SECOND EXAMPLE

Figure 19:
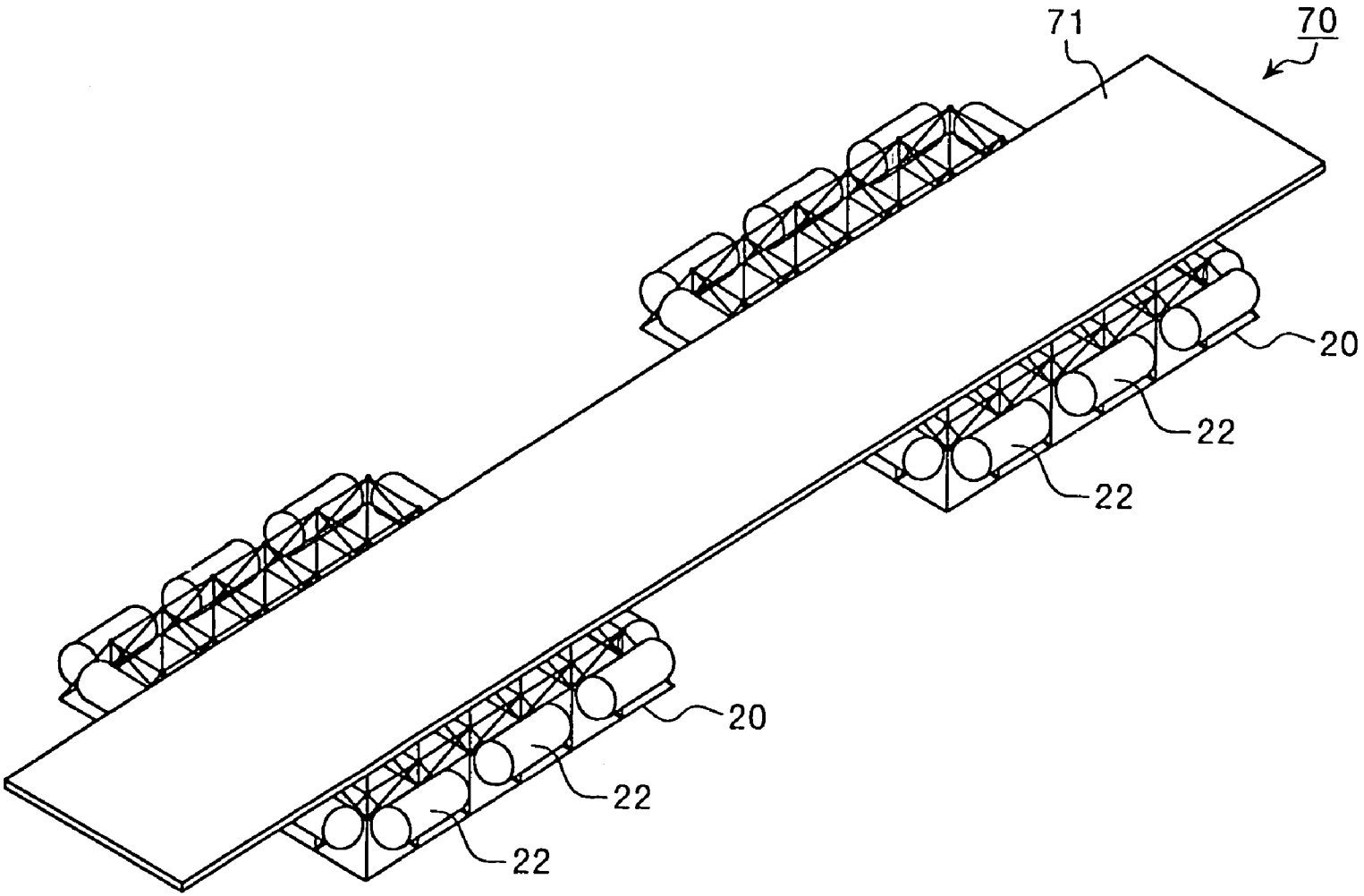
FIG. 19 is a structural drawing of a second example application of the planar member.

The planar member may also be used as a structural element of a bridge. FIG. 19 is a structural drawing of a second example application of the planar member. In FIG. 19, the same numerals for the same structural elements as those in the first embodiment are used, and the explanation thereof is omitted. A bridge 70 is a prefabrication-type simple bridge. Workers can manually assemble this bridge in a short time in case of emergency. The bridge 70 includes a planar member 71 and floating structures 20. Similar to the planar member 10 of the first embodiment, the planar member 71 is constructed by joining a plurality of the deck materials 11 in the width and the longitudinal directions, and has a single piece of approximately plate-like structure (see FIGS. 2 to 6). Owing to the structure, the planar member 71 has a load distribution function. The planar member 71 is constructed by appropriately adding the deck materials 11 so that the length of the planar member 71 is longer than the width of the river over which the planar member 71 is arranged. Moreover, the floating structures 20 floating on the river support the bottom of the planar member 71, and the both ends of the planar member 71 are mounted on the banks of the river. The planar member 71 may bend due to the weight of cars passing over the bridge 70 and the like, and the floating structure 20 is appropriately added according to the width of the river so that the bridge 70 does not sink. In this second example, to further increase the strength of the bridge 70, the planar members 40, 41 and 50, which can be layered, may be used in place of the planar member 10 (see FIGS. 9 to 17). When the planar members 40, 41 and 50 are used, the joining pieces 47 enable the layered structure (see FIG. 10) to securely retain the planar members 40, 41 and 50 in a state of face-to-face contact with one another. This leads to an advantage that the strength of the bridge 70 further enhances. The material of the deck material 11 that constitutes the planar member 10 is not limited to aluminum, and it may be appropriately changed within the range that is obvious to those skilled in the art, depending on the application.

The bridge 70 of the second example is easy to build manually over a desired river; this is particularly beneficial in case of emergency. Moreover, the planar member 71 and the floating structure 20 are both made of small materials such as deck material 11 and truss material. Therefore, these materials are separately delivered by truck. This leads to an advantage that building a bridge over a desired river is easy. The bridgeboard of the bridge 70 is constructed from the planar member 71 having a single piece of approximately plate-like structure, and thus is sturdy compared to when a bridge is constructed by simply placing board material on the floating structure 20. The bridgeboard of the bridge 70 can be extended by adding the deck materials 11. This leads to an advantage that the length of the bridgeboard can be adjusted depending on the width of the river.

INDUSTRIAL APPLICABILITY

As described above, the heliport and the building and construction members according to the present invention can be arranged on a simple floating structure, and have strength tolerable for peculiar impact load and concentrated load. Therefore, the heliport and the building and construction members are useful for such applications.

The invention claimed is:

1. A building member comprising:

a plurality of deck materials having at least two different types in length, each deck material including at least one enclosed hollow portion defined by longitudinally extending walls for joining in a longitudinal direction and a projection on one side and a depression on the other side for engagement in a width direction: and a joining member for joining one deck material to one other deck material in the longitudinal direction, with a portion at one end of the joining member inserted in the enclosed hollow portion of the one deck material and a remaining portion at the other end thereof inserted in the enclosed hollow portion of the other deck material, in which the projection and the depression of the one deck material engage with the depression and the projection, respectively, of other adjacent deck materials in the width direction so that the other deck materials in the longitudinal and width directions are assembled with the one deck material to construct a planar member having a single plane of a predetermined area.

2. The building member according to claim 1, wherein the deck materials are made of aluminum.

3. The building member according to claim 1, wherein the joining member functions as a reinforcing member.

4. The building member according to claim 1, wherein the hollow enclosed portion has a rectangular cross-section.

5. A building member comprising:

a plurality of deck materials having at least two different types in length, each deck material including at least one enclosed hollow portion defined by longitudinally extending walls for joining in a longitudinal direction and a projection on one side and a depression on the other side for engagement in a width direction, the deck material having at least one rail provided with an open hollow portion and an opening on one of a top surface and a bottom surface, said open hollow portion and opening extending in the longitudinal direction;

a joining member for joining one deck material to one other deck material in the longitudinal direction, with a portion at one end of the joining member inserted in the enclosed hollow portion of the one deck material and a remaining portion at the other end thereof inserted in the enclosed hollow portion of the other deck material, in which the projection and the depression of the one deck material engage with the depression and the projection, respectively, of other adjacent deck materials in the width direction so that the other deck materials in the longitudinal and width directions are assembled with the one deck material to construct a first planar member and a second planar member having a single plane of a predetermined area, respectively; and a plurality of joining pieces each having a portion insertable in the open hollow portion of said rails of the deck materials of the first and second planar members and having a portion extending through said opening for joining the planar members, in which the first planar member and the second planar member are joined to each other through the joining pieces to constitute a double-layered structure by a surface contact.

6. The building member according to claim 5, wherein the deck materials are made of aluminum.

7. The building member according to claim 5, wherein the joining member functions as a reinforcing member.

8. The building member according to claim 5, wherein the joining piece portion insertable in the open hollow portion of said rails has a plate-like portion that is square-shaped.

9. The building member according to claim 8, wherein the first planar member and the second planar member are joined so that the longitudinal directions of the first and second planar members are orthogonal.

10. A building member comprising:

a plurality of first deck materials having at least two different types in length, each first deck material including at least one enclosed hollow portion defined by longitudinally extending walls for joining in a longitudinal direction and a projection on one side and a depression on the other side for engagement in a width direction, the first deck material having at least one rail provided with an open hollow portion and an opening on one of a top surface and a bottom surface, said open hollow portion and opening extending in the longitudinal direction;

a plurality of second deck materials having at least two different types in length, each second deck material including at least one enclosed hollow portion defined by longitudinally extending walls for joining in a longitudinal direction and a projection on one side and a depression on the other side for engagement in a width direction, the second deck material having at least one rail provided with an open hollow portion and an opening on each of a top surface and a bottom surface, said open hollow portion and opening extending in the longitudinal direction;

a joining member for joining one first deck material to one other first deck material and one second deck material to one other second deck material in the longitudinal direction, with a portion at one end of the joining member inserted in the enclosed hollow portion of the one deck material and a remaining portion at the other end thereof inserted in the enclosed hollow portion of the other deck material, respectively, in which the projection and the depression of the one first deck material engage with the depression and the projection, respectively, of other adjacent first deck materials in the width direction so that the other first deck materials in the longitudinal and width directions are assembled with the one first deck material to construct a first planar member and a second planar member having a single plane of a predetermined area, respectively, and in which the projection and the depression of the one second deck material engage with the depression and the projection, respectively, of other adjacent second deck materials in the width direction so that the other second deck materials in the longitudinal and width directions are assembled with the one second deck material to construct at least one third planar member having a single plane of a predetermined area; and a plurality of joining pieces each having a portion insertable in the en hollow portion of said rails of the first and second deck materials of the first, second and third planar members and having a portion extending through said opening for joining the planar members, in which the first planar member is joined to the third planar member and the third planar member is joined to the second planar member, through the joining pieces, to constitute a triple-layered structure by a surface contact.

11. The building member according to claim 10, wherein the first and second deck materials are made of aluminum.

12. The building member according to claim 10, wherein the joining member functions as a reinforcing member.

13. The building member according to claim 10, wherein the joining piece portion insertable in the open hollow portion of said rails has a plate-like portion that is square-shaped.

14. The building member according to claim 13, wherein the first planar member and the third planar member are joined and the third planar member and the second planar member are joined, respectively, so that the longitudinal directions of the first and third planar members and those of the third and second planar members are orthogonal, respectively.

* * * * *